US005899346A

United States Patent [19]

Newkirk

[11] Patent Number: 5,899,346

[45] Date of Patent: May 4, 1999

[54] FOLDABLE SHELVING UNIT

[75] Inventor: John Robert Newkirk, Bonita Springs, Fla.

[73] Assignee: Zenith Products Corp., New Castle, Del.

[21] Appl. No.: 08/852,199

[22] Filed: May 6, 1997

[51] Int. Cl.[6] ..... A47F 5/00

[52] U.S. Cl. ..... 211/149; 211/150; 211/201; 108/176

[58] Field of Search ..... 211/149, 150, 211/201, 186; 108/176, 179, 186, 124, 134, 135

[56] References Cited

U.S. PATENT DOCUMENTS 1,158,212 10/1915 Henderson ..... 211/149 X
1,727,048 9/1929 Cady ..... 211/150 X
3,322,077 5/1967 Kovacik ..... 211/150 X
5,505,318 4/1996 Goff ..... 211/150 X
5,577,622 11/1996 Kapteyn ..... 211/149 X

*Primary Examiner*—Robert W. Gibson, Jr.
*Attorney, Agent, or Firm*—Edgar A. Zarins; Leon E. Redman

[57] ABSTRACT

A space saver shelving unit adapted to straddle the tank of a toilet for convenient shelves above the tank. The shelving unit includes detachable leg members which connect to a folding upper section. The upper section has a plurality of shelves pivotably attached to a rear panel and front posts. The leg members are secured to the back panel and posts to supply rigidity retaining the shelves in their proper position. The foldable shelving unit allows for convenient storage and shipment by folding to a flat surface.

7 Claims, 4 Drawing Sheets

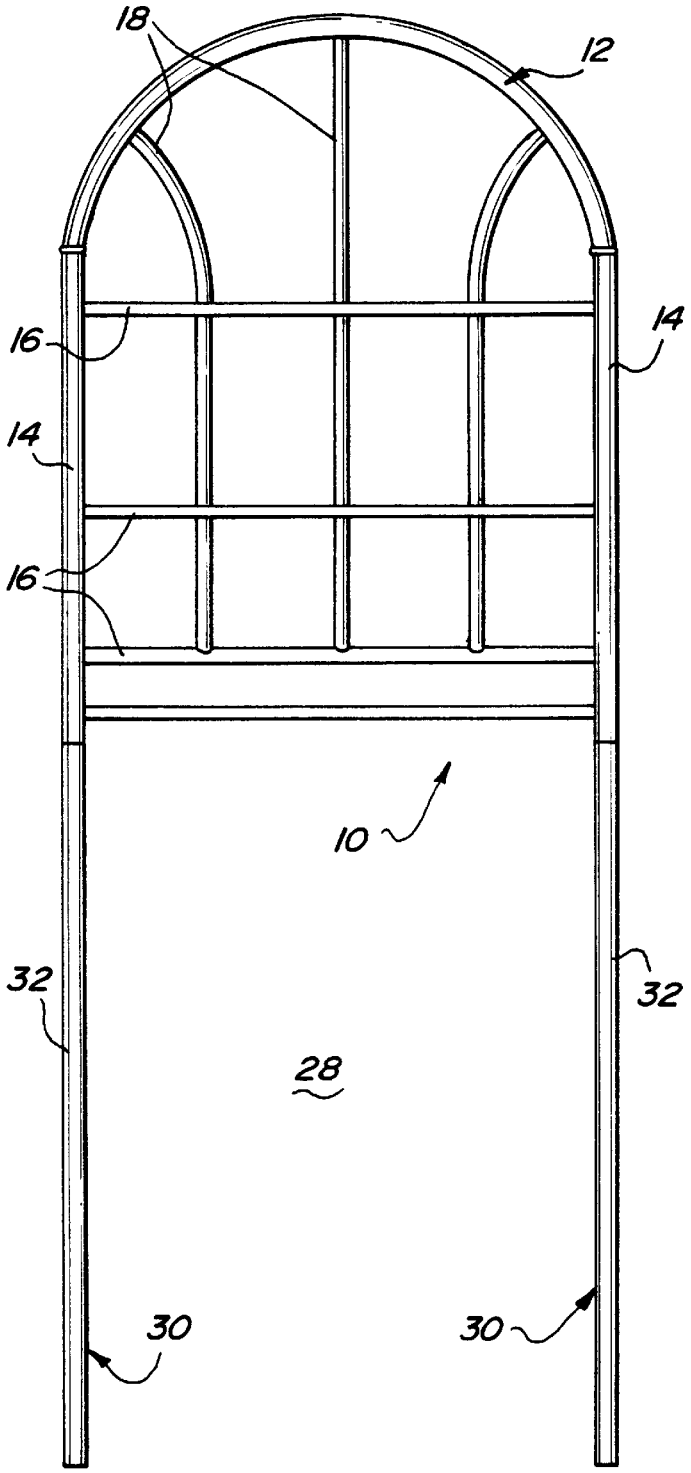
Fig-3
Fig-4
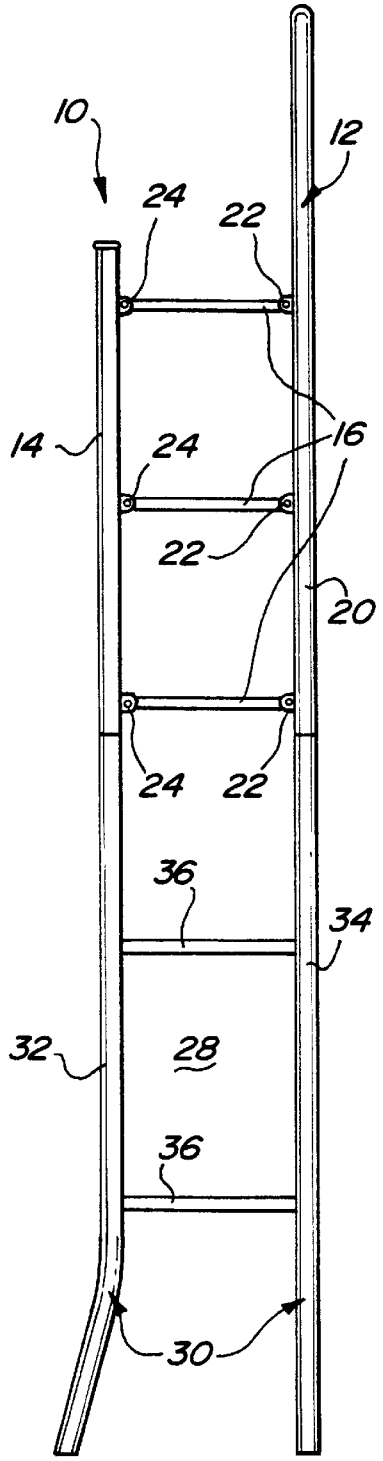

FOLDABLE SHELVING UNIT

BACKGROUND OF THE INVENTION

I. Field of the Invention

The present invention is directed to a freestanding shelving unit adapted to be positioned above the toilet and, in particular, to a shelving unit which may be selectively folded to a compact assembly convenient for storage and shipment.

II. Description of the Prior Art

Convenience devices have become increasingly popular for increasing storage areas in the home particularly the bath area which is typically devoid of closet space. Shower caddies for the bath and shelving units can be positioned in corners or other open areas to increase storage. An additional open area is the wall space above the toilet. Wall mounted cabinets and free-standing shelving units have become popular devices to fill these areas. However, because of their size, fully assembled devices can be expensive to ship. Alternatively, the devices are shipped disassembled requiring the user to assemble the product in the home. In addition to requiring tools for assembly, the assembly process can become tedious and frustrating.

SUMMARY OF THE PRESENT INVENTION

The present invention overcomes the disadvantages of the prior known shelving units by providing a foldable unit which is convenient for the user to carry home and can be quickly assembled without tools.

The shelving unit of the present invention includes a back panel having a plurality of shelves pivotably attached thereto. Pivotably attached to the front corners of the shelves are front posts although a front panel could by substituted for the front posts. The shelves are pivotably attached to the rear panel and front posts by simple hinges which allows the shelves to fold downwardly relative to the back panel forming a compact, substantially flat assembly. In order to support the upper unit in the extended position with the shelves horizontal, legs are connected between the back panel and front posts. The leg members each include front and back legs with cross supports to span and support the rear panel and post respectively. The leg members have a substantially planar construction facilitating storage with the folded upper unit. However the leg members can be each quickly mounted between the rear panel and front posts to form the shelving unit. The shelving unit can now be positioned as desired with the legs supporting the upper shelving unit.

Other objects, features and advantages of the invention will be apparent from the following detailed description taken in connection with the accompanying drawing.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 3 is a front elevational view thereof;

FIG. 4 is a left side view thereof;

DETAILED DESCRIPTION OF A PREFERRED EMBODIMENT OF THE PRESENT INVENTION

Figure 1:
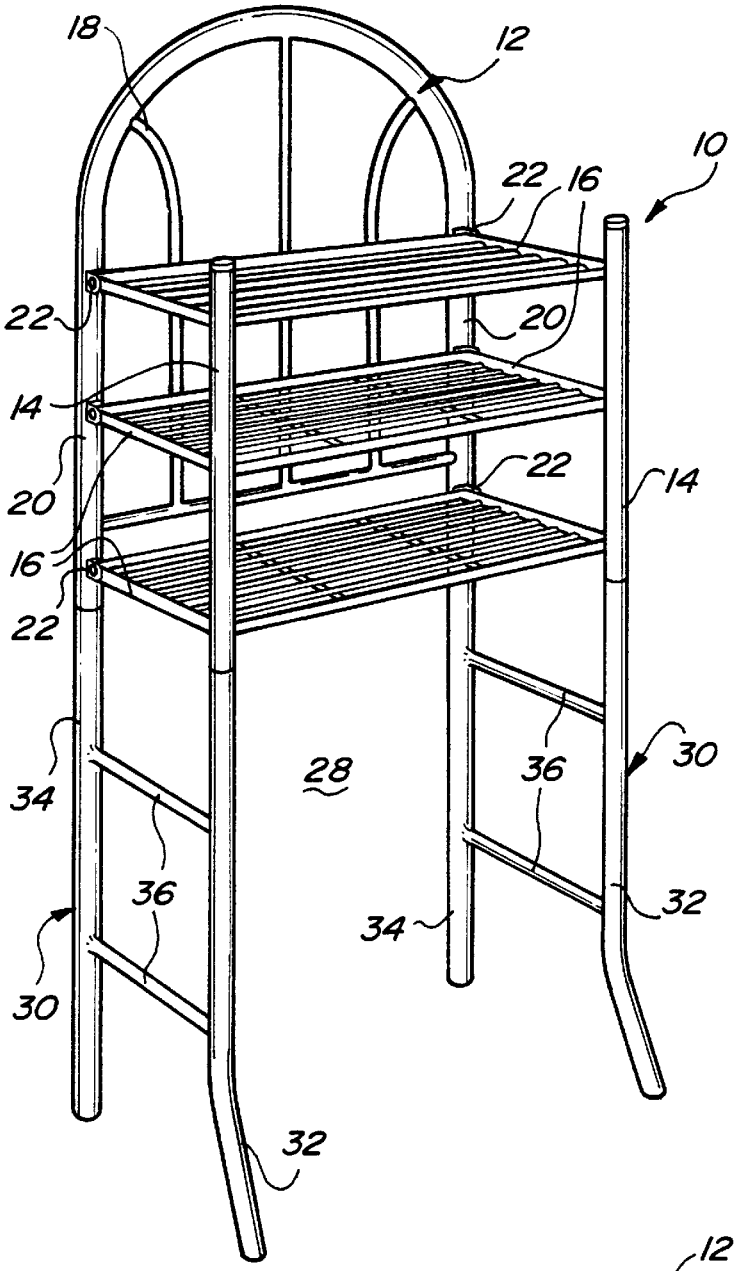
FIG. 1 is a perspective view of a shelving unit embodying the present invention.
Figure 2:
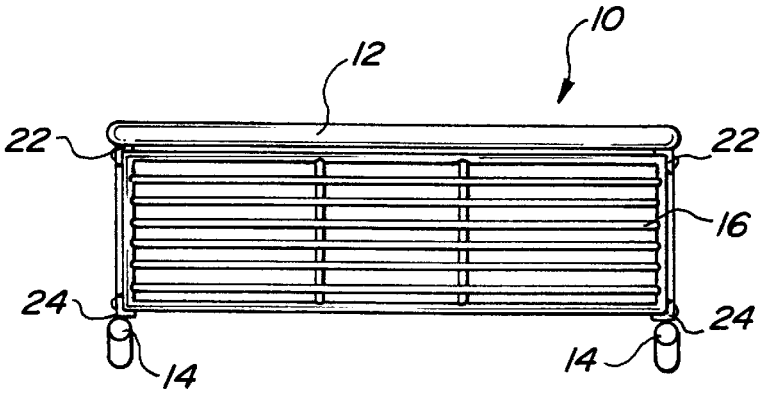
FIG. 2 is a top plan view thereof.
Figure 5:
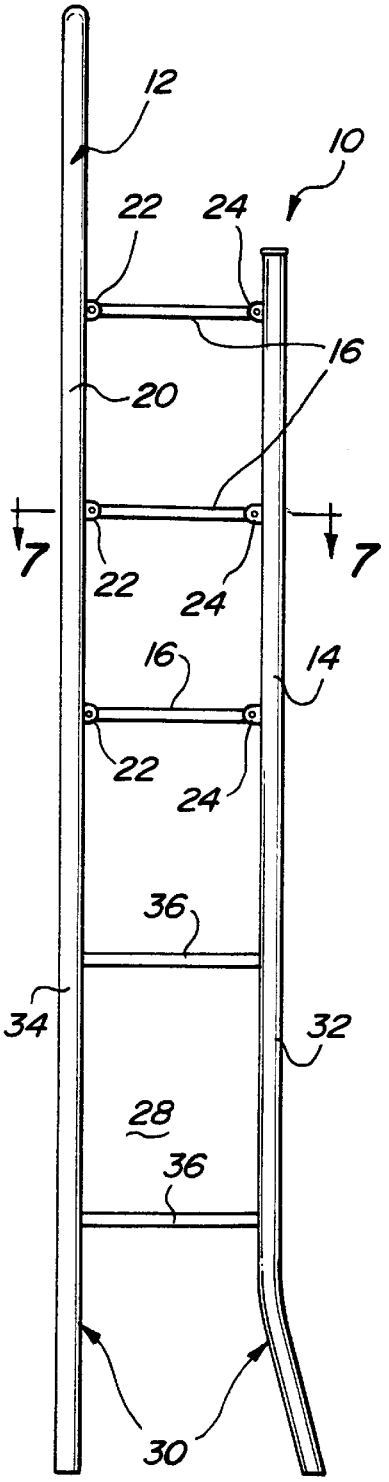
FIG. 5 is a right side view thereof.
Figure 6:
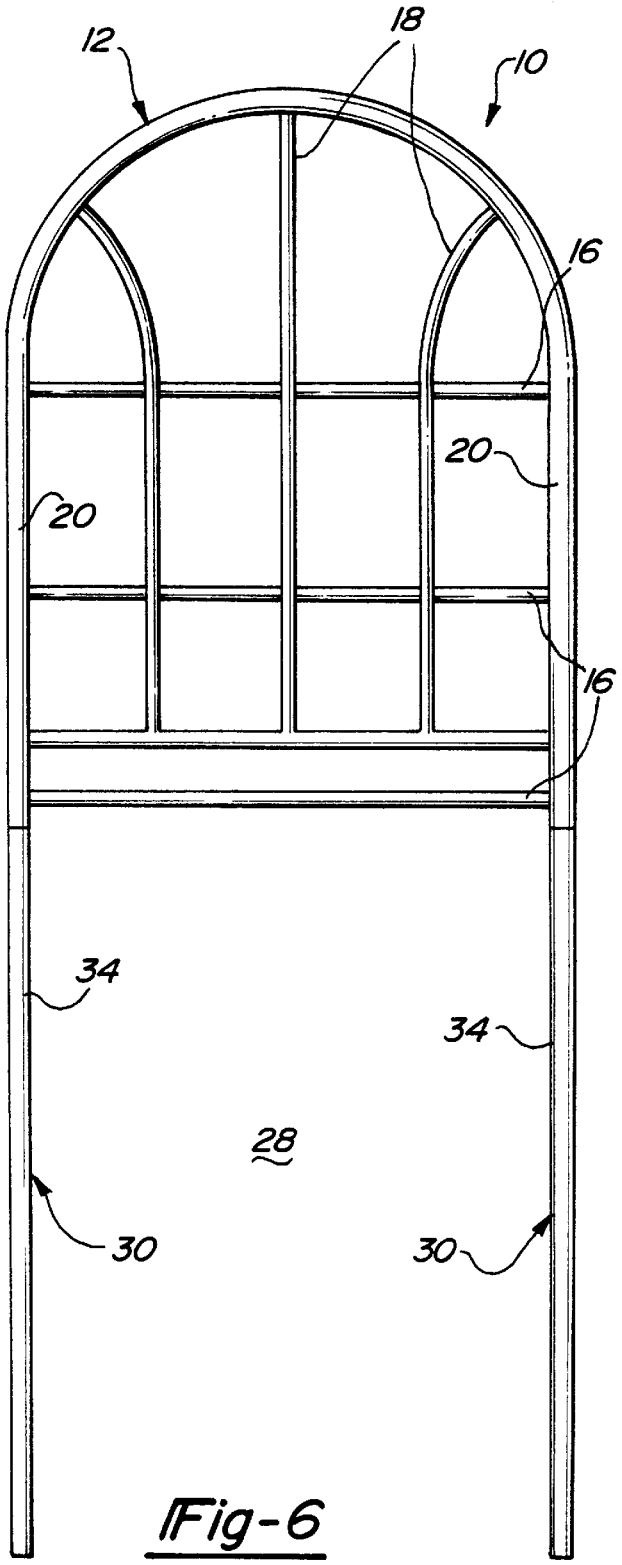
FIG. 6 is a rear elevational view thereof.

Referring to FIGS. 1 through 5, there is shown a shelving unit 10 embodying the present invention and providing a convenient storage area such as for a bathroom. The shelving unit 10 of a preferred embodiment is designed to straddle a water closet or toilet so as to provide storage shelves above the closet tank to take advantage of the empty wall space. However, the inventive concepts embodied in the present invention may be utilized in alternative shelving units.

The shelving unit 10 of the present invention includes a back panel 12 and front posts 14 to which a plurality of shelves 16 are pivotably attached. The back panel 12 preferably incorporates a decorative pattern 18 of a tubular construction including rear posts 20. The shelves 16 are hingedly attached to the rear posts 20 through hinges 22 secured to the posts 20 to facilitate pivotable movement of the shelves 16 relative to the back panel 12. The shelves 16 are similarly hingedly attached to the front posts 14 through hinges 24 secured to the posts 14 to facilitate pivotable movement of the shelves 16 relative to the front posts 14. As a result, the back panel 12, the front posts 14 and the shelves 16 all pivot freely relative to each other.

In order to support the shelves 16 in a horizontal position suitable for the placement of objects, a pair of leg members 30 are attached between the posts 14 and 20 thereby creating an open area 28 below the shelves 16 suitable to straddle the toilet tank. In a preferred embodiment, each of the leg members 30 is connected between the front post 14 and rear post 20. The leg members 30 include a front leg 32 and a rear leg 34 adapted to matingly engage the front post 14 and rear post 30, respectively. Cross members 36 extend between and are fixedly connected to the leg members 32 and 34, respectively, to provide structural rigidity to the leg members 30. Upon connecting the leg members 30 to the back panel 12 and front posts 14, this structural rigidity is supplied to the folding upper section of the shelving unit 10. As a result, the back panel 12 and front posts 14 are maintained substantially parallel with the shelves 16 extending horizontally therebetween.

Figure 7:
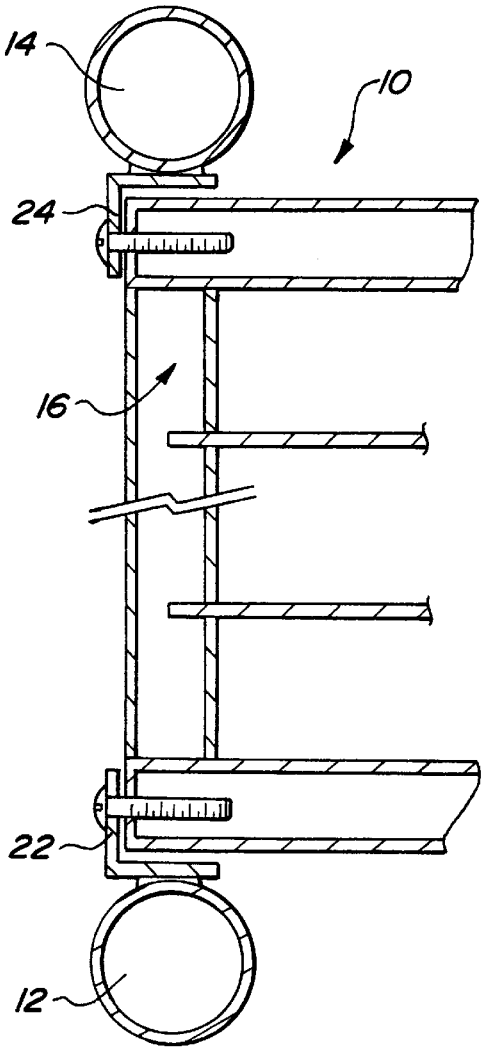
FIG. 7 is a partial cross-sectional view taken along lines 7—7 of FIG. 5.
Figure 8:
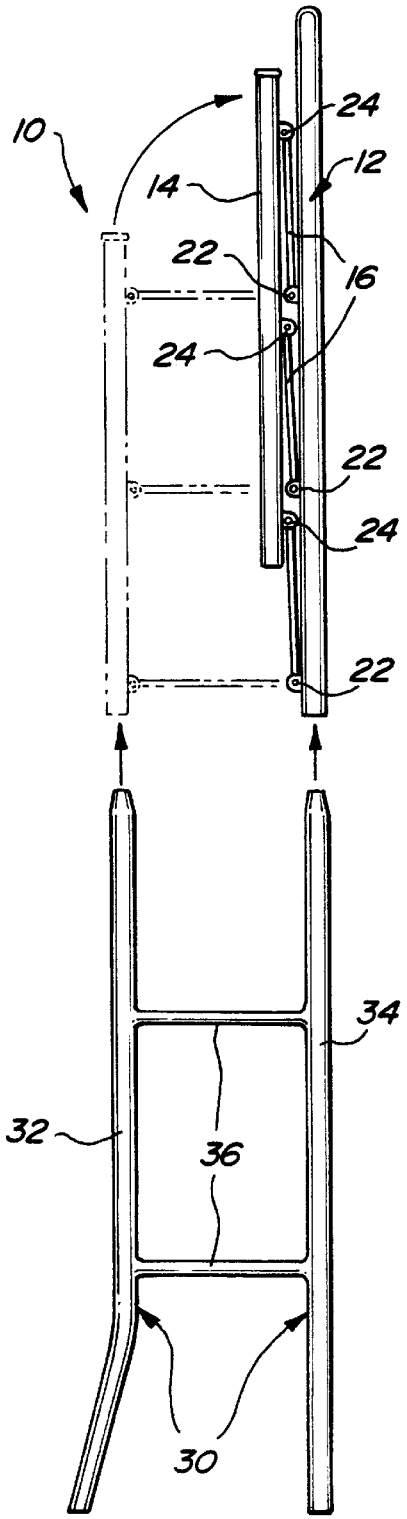
FIG. 8 is a side view of the shelving unit folded for storage and shipment.

As best shown in FIGS. 7 and 8, the hinges 22 and 24 allow the entire shelving unit 10 to be collapsed into a compact arrangement for storage and shipment. With the leg members 30 removed, the front posts 14 and shelves 16 can pivot against the back panel 12 as shown in FIG. 8. The leg members 30 are stored against the rear panel 12 also. Once the consumer unpacks the shelving unit 10 it can be quickly assembled without tools. The front posts 14 and shelves 16 are pivoted away from the rear panel 12 until the shelves 16 are substantially perpendicular to the front posts 14 and rear panel 12. The leg members 20 are connected to the upper section by inserting the front leg 32 into the front post 14 and inserting the rear leg 34 into the rear post 20 of the back panel 12. The entire unit 10 can now be placed upright on the leg members 30 to provide the desired shelving for storage. In the event it ever becomes necessary to disassemble the shelving unit 10, the leg members 20 may be removed allowing collapse of the upper section.

The foregoing detailed description has been given for clearness of understanding only and no unnecessary limitations should be understood therefrom as some modifications will be obvious to those skilled in the art without departing from the scope and spirit of the appended claims.

What is claimed is:

1. A selectively foldable shelving unit comprising:

a rigid back panel having downwardly disposed posts;

at least one shelf pivotably attached to said back panel;

at least two front posts pivotably attached to said at least one shelf whereby said at least two front posts are pivotable relative to said at least one shelf while said at least one shelf is pivotable relative to said back panel to selectively move between a collapsed position and an upright position; and a pair of leg members to maintain said shelving unit in said upright position, each of said leg members connected to one of said front posts and one of said posts of said back panel.

2. The shelving unit as defined in claim 1 wherein said rigid back panel includes a plurality of hinges pivotably connecting said at least one shelf to said back panel.

3. The shelving unit as defined in claim 2 wherein a plurality of shelves are hingedly attached to said back panel.

4. The shelving unit as defined in claim 3 wherein said hinges are secured to said downwardly disposed posts of said back panel such that said shelves are hingedly attached to said posts of said back panel.

5. The shelving unit as defined in claim 4 wherein said shelving unit includes a pair of front posts having a plurality of hinges pivotably connecting said shelves to said front posts, said front posts disposed along a front edge of said shelves.

6. The shelving unit as defined in claim 5 wherein said leg members include a front leg and a rear leg connected by at least one cross support, said front leg matingly connected to a front post and said rear leg matingly connected to a post of said back panel.

7. A selectively foldable shelving unit comprising:

a rigid back panel having downwardly disposed posts formed along outer edges of said back panel;

a plurality of shelves hingedly secured to said posts of said back panel such that said shelves selectively pivot relative to said back panel;

a pair of front posts, said shelves hingedly secured to said front posts such that said shelves selectively pivot relative to said front posts to selectively move between a collapsed position for compact storage and an upright position; and a pair of leg members to maintain said shelving unit in said upright position, each of said leg members connected to one of said front posts and one of said posts of said back panel thereby maintaining said front posts in spaced relation to said back panel to support said shelves horizontally between said front posts and said back panel such that removal of said leg members allows said front posts and shelves to pivot to said collapsed position proximate said back panel.

* * * * *